US009936781B2

(12) United States Patent
Lindholm

(10) Patent No.: US 9,936,781 B2
(45) Date of Patent: Apr. 10, 2018

(54) PORTABLE MONITOR AND ELECTRONIC DEVICE CARRIER

(71) Applicant: Raymond Lindholm, Edina, MN (US)

(72) Inventor: Raymond Lindholm, Edina, MN (US)

( * ) Notice: Subject to any disclaimer, the term of this patent is extended or adjusted under 35 U.S.C. 154(b) by 0 days.

(21) Appl. No.: 15/229,865

(22) Filed: Aug. 5, 2016

(65) Prior Publication Data

US 2017/0035167 A1 Feb. 9, 2017

Related U.S. Application Data

(60) Provisional application No. 62/201,165, filed on Aug. 5, 2015.

(51) Int. Cl.

| | |
|---|---|
| ***A45C 11/00*** | (2006.01) |
| ***A45C 13/26*** | (2006.01) |
| ***A45C 5/14*** | (2006.01) |
| ***A45C 13/28*** | (2006.01) |
| *A45C 13/00* | (2006.01) |
| *A45C 13/02* | (2006.01) |

(52) U.S. Cl.

CPC ..... *A45C 11/00* (2013.01); *A45C 5/14* (2013.01); *A45C 13/262* (2013.01); *A45C 13/28* (2013.01); *A45C 13/005* (2013.01); *A45C 2011/003* (2013.01); *A45C 2013/025* (2013.01)

(58) Field of Classification Search

CPC ..... A45C 11/00; A45C 5/141; A45C 13/005; A45C 13/02; A45C 13/262; A45C 2005/142; A45C 2011/003; A45C 2013/025

See application file for complete search history.

(56) References Cited

U.S. PATENT DOCUMENTS

| | | | | |
|---|---|---|---|---|
| 1,838,240 | A * | 12/1931 | Vineberg | A45C 13/03 190/13 H |
| 4,294,496 | A | 10/1981 | Murez | |
| 4,669,053 | A | 5/1987 | Krenz | |
| 4,854,602 | A * | 8/1989 | Takeuchi | A45C 13/02 190/122 |
| 5,474,162 | A * | 12/1995 | Shyr | A45C 13/262 190/109 |
| 6,442,018 | B1 | 8/2002 | Dinkin | |
| 6,578,708 | B2 * | 6/2003 | Barnett | A45C 13/02 190/1 |
| 6,654,235 | B2 | 11/2003 | Imsand | |

(Continued)

*Primary Examiner* — Tri Mai

(74) *Attorney, Agent, or Firm* — Global Intellectual Property Agency, LLC; Jordan Sworen

(57) ABSTRACT

A portable monitor and electronic device carrier. The carrier includes an openable interior volume that is configured to conform to the volume of an electronic display screen and an electronic article. The carrier further includes a support member pivotably secured to an interior surface of the lid. An electronic display screen is fastenable to the support member via inserting fasteners through slots in the support member, which then engage integral female receivers on the electronic display screen. The carrier further includes a strap extending across an interior surface of the base, which is configured to secure an electronic article, such as a video game console, in place. The carrier still further includes wheels disposed on an exterior surface of the base and a telescopic handle extendable from the carrier.

9 Claims, 5 Drawing Sheets

(56) References Cited

U.S. PATENT DOCUMENTS

| | | | | |
|---|---|---|---|---|
| 7,819,247 | B2 | 10/2010 | Gonzalez | |
| 8,499,955 | B2 * | 8/2013 | Vazquez | A47F 7/08 190/100 |
| 2002/0134697 | A1 * | 9/2002 | Barnett | A45C 13/02 206/320 |
| 2008/0134946 | A1 * | 6/2008 | Alonso | A45C 9/00 108/50.11 |
| 2008/0251340 | A1 * | 10/2008 | Huber | A45C 3/12 190/112 |
| 2010/0231101 | A1 | 9/2010 | Rubin | |

* cited by examiner

PORTABLE MONITOR AND ELECTRONIC DEVICE CARRIER

CROSS REFERENCE TO RELATED APPLICATIONS

This application claims the benefit of U.S. Provisional Application No. 62/201,165 filed on Aug. 5, 2015. The above identified patent application is herein incorporated by reference in its entirety to provide continuity of disclosure.

BACKGROUND OF THE INVENTION

The present invention relates to entertainment centers. More specifically, the present invention relates to self-contained containers or supports configured for use with monitors or screens in conjunction with video game systems, computers, and other electronic media devices.

Transporting electronic articles, e.g. video game consoles, and their associated monitors or display screens can be challenging due to the cumbersome nature of such devices. Because they are heavy and take up a substantial amount of space, they are difficult to transport using conventional luggage. Furthermore, they can also be quite fragile and easily broken if not secured properly, which is likewise difficult to accomplish using conventional luggage. Therefore, there is a need in the prior art for a carrier specifically adapted for securely transporting the combination of an electronic article and an electronic display device in a secure and easily transportable manner.

SUMMARY OF THE INVENTION

In view of the foregoing disadvantages inherent in the known types of carrying devices now present in the prior art, the present invention provides a carrier for an assembly of an electronic display screen and an electronic article. The carrier includes a base, a sidewall extending from the base, and a lid pivotably secured to the sidewall. The base, the sidewall, and the lid form an enclosed interior volume when the lid is closed that is configured to conform to the volume of an electronic display screen and an electronic article. The carrier further includes a support member pivotably secured to an interior surface of the lid. An electronic display screen is fastenable to the support member via inserting fasteners through slots in the support member, which then engage integral female receivers on the electronic display screen. The carrier further includes a strap extending across an interior surface of the base, which is configured to secure an electronic article, such as a video game console, in place. The carrier still further includes wheels disposed on an exterior surface of the base and a telescopic handle extendable from the carrier.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
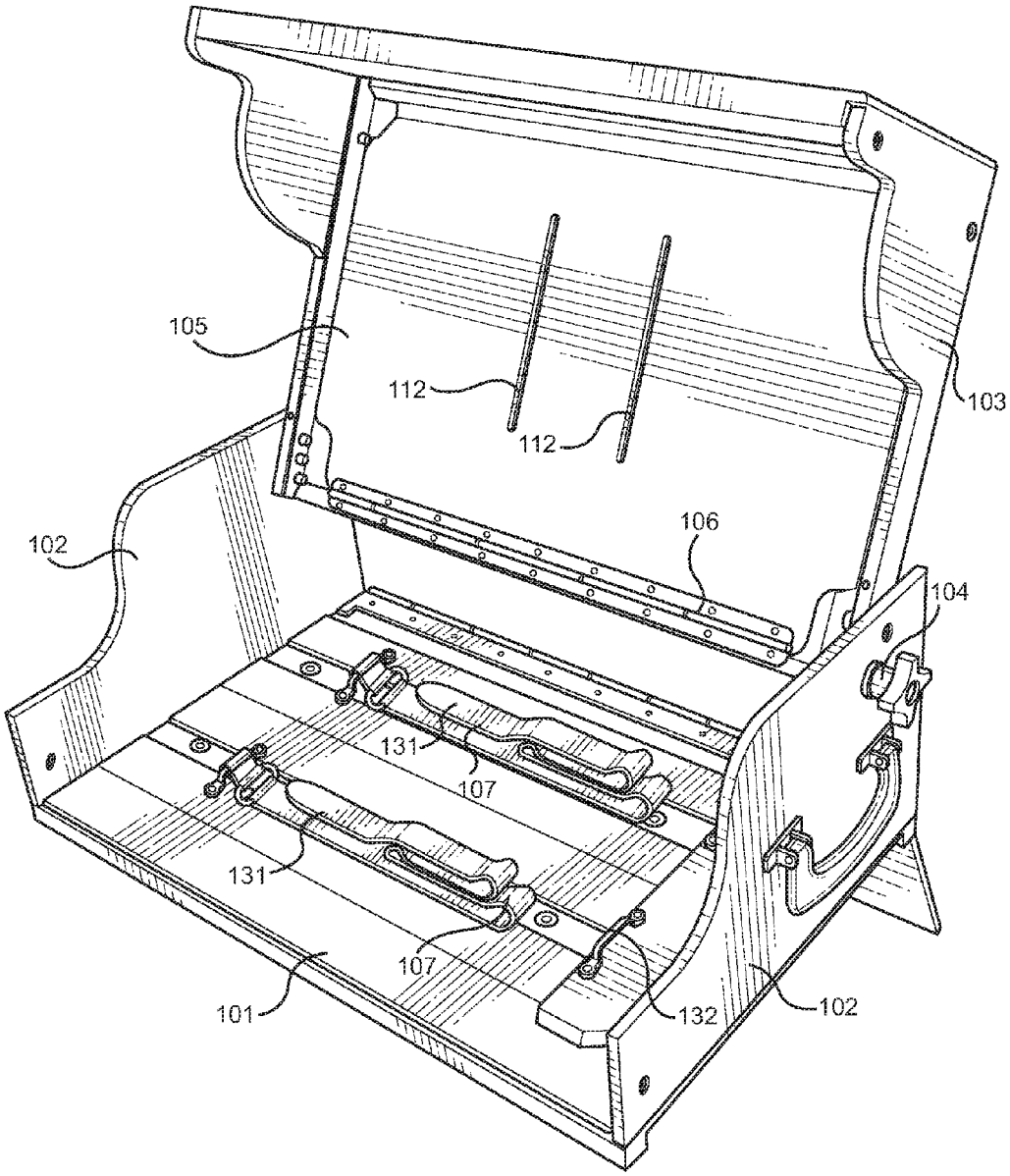
FIG. 1 shows a perspective view of the portable monitor and electronic device carrier in an open position.
Figure 2:
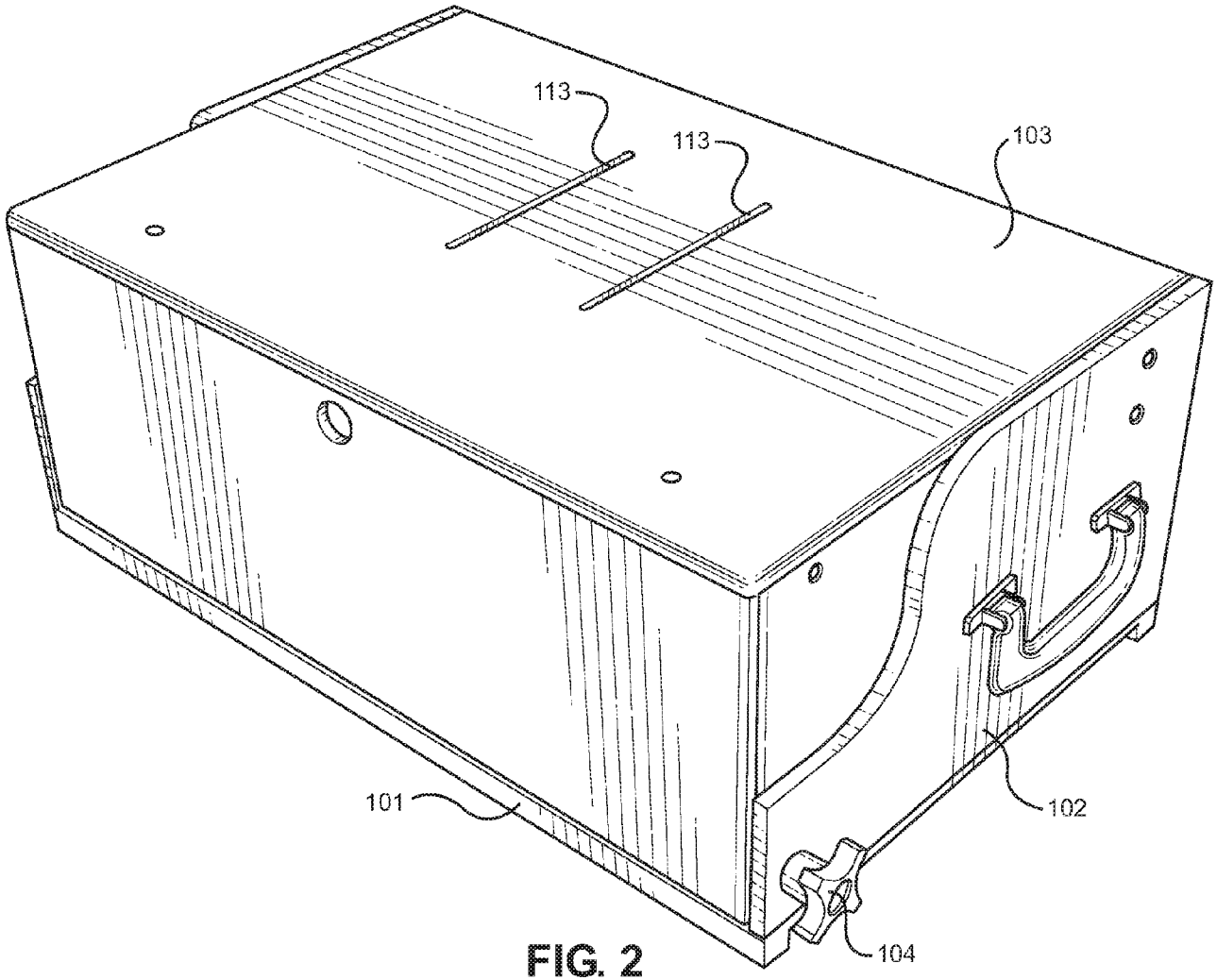
FIG. 2 shows a perspective view of the portable monitor and electronic device carrier in a closed position.
Figure 3:
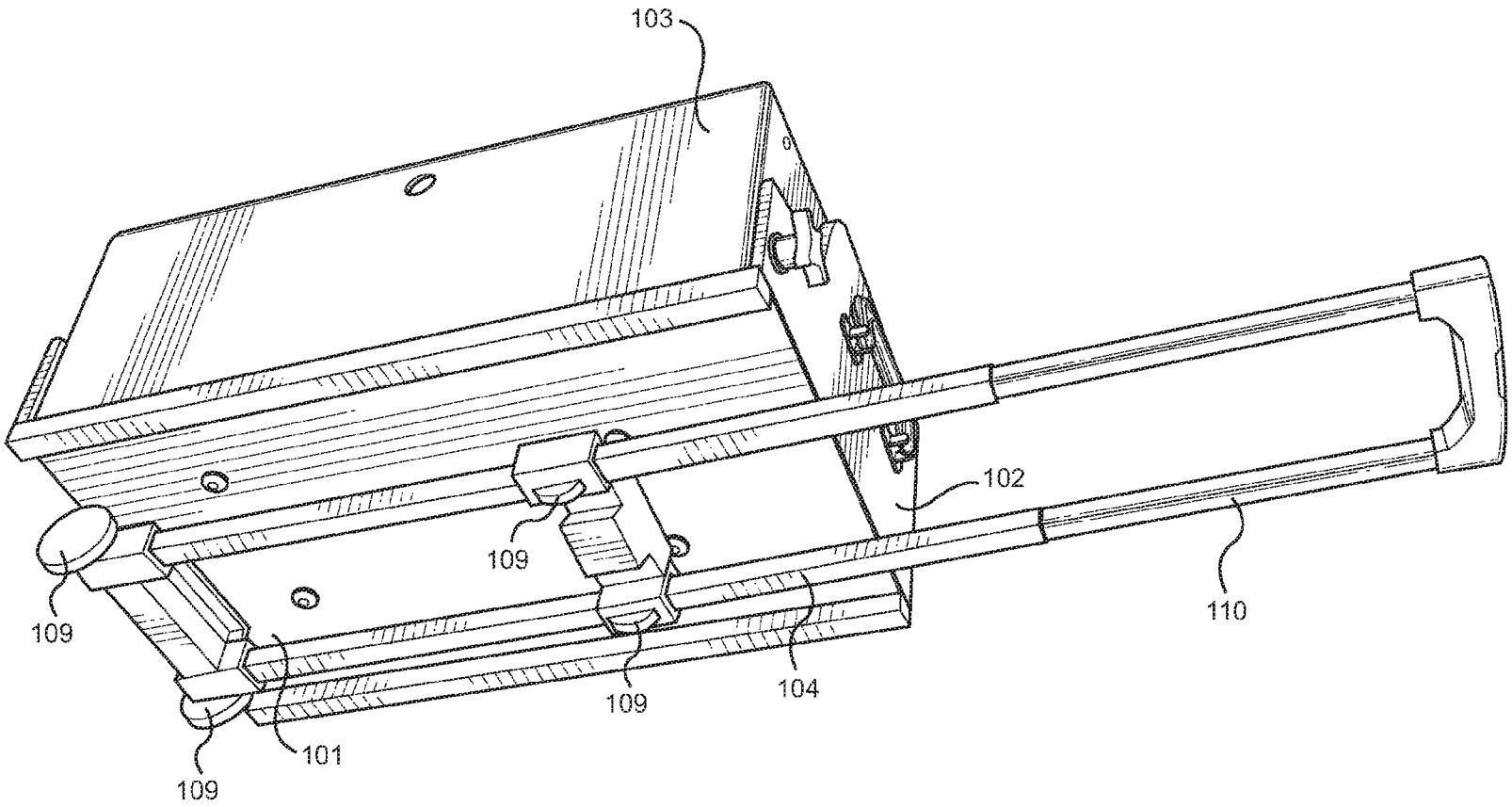
FIG. 3 shows a perspective view of the reverse side of the portable monitor and electronic device carrier.
Figure 4:
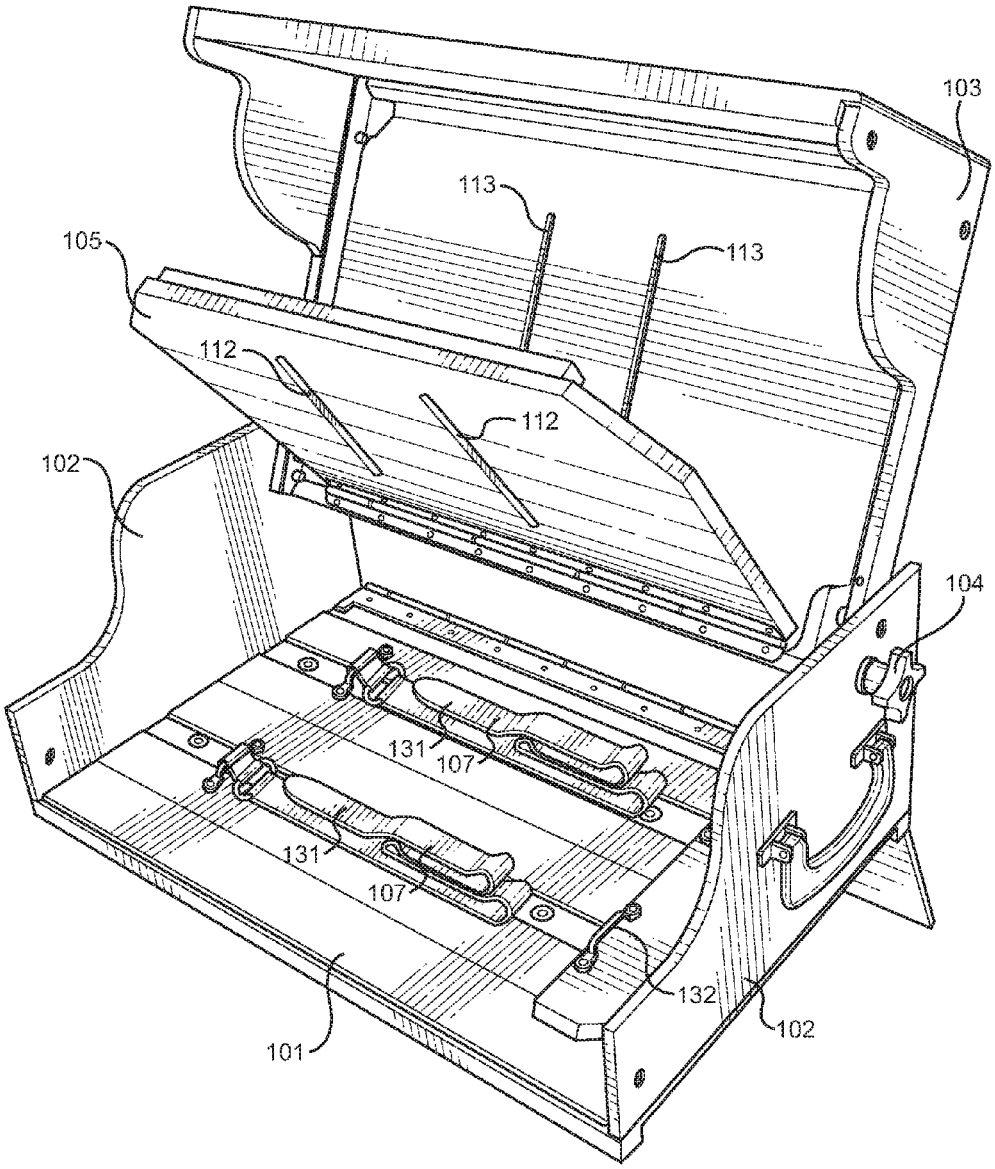
FIG. 4 shows a perspective view of the support of the portable monitor and electronic device carrier in a pivoted position.

Reference is made herein to the attached drawings. Like reference numerals are used throughout the drawings to depict like or similar elements of the XXX. The figures are intended for representative purposes only and should not be considered to be limiting in any respect.

Referring now to FIGS. 1-4, there are shown various perspective views of the portable monitor and electronic device carrier. The carrier includes a base 101, a pair of sidewalls 102 extending vertically from the edges of the base 101, and a lid 103 pivotably connected to the sidewalls 102 via hinges 104. The lid 103 is configured to pivot between an open position, wherein the lid 103 is oriented vertically and generally orthogonally relative to the base 101, and a closed position, wherein the lid 103 is oriented horizontally and generally parallel relative to the base 101. When in the closed position, the base 101, the sidewalls 102, and the lid 103 form an enclosed interior volume configured to receive a monitor and an electronic article, e.g. a video game console. In one embodiment, the base 101 is planar in order to support the electronic device thereon in a level orientation.

The lid 103 is configured to support a computer monitor or other electronic display thereon. In one embodiment, the lid 103 further includes a support member 105 pivotably attached to the interior surface thereof by a hinge 106. The support member 105 includes at least one slot 112 thereon extending laterally across the support member 105. A fastener can be inserted through each slot 112 and secured to a corresponding female receiver, e.g. a threaded aperture, on the back of the display screen. In one embodiment, the support member 105 includes two separate slots 112 that are separated a distance equal to the distance between female receivers on a conventional flat screen television. In one embodiment, the lid 103 is planar so that the electronic display can rest level thereagainst.

In one embodiment, the lid 103 further includes complementary slots 113 that are aligned with the corresponding slots 112 disposed on the support member 105. In this embodiment, an electronic display screen can therefore be secured to either the support member 105, the lid 103, or through both the support member 105 and the lid 103 via a fastener.

The carrier further includes one or more straps 107 extending longitudinally across the interior surface of the base 101. The straps 107 are configured to secure an article, e.g. a video game console, against the base 101. The straps 107 are configured to be adjustable in length, thereby allowing the carrier to accommodate differently sized articles. In an illustrative embodiment, the straps 107 are fixedly secured to the base 101 at a first end and include hook-and-loop fastening material 131 at the second end. The second end of the straps 107 is looped through a bracket 132 and then secured to a complementary patch of the hook-and-loop fastening material 131. In alternative embodiments of the carrier, the straps 107 include a ratcheting mechanism or any other mechanism configured to adjust the length of the straps 107.

The carrier further includes wheels 109 positioned on the exterior surface of the base 101 and a telescopic handle 110 likewise extending therefrom. The wheels 109 extend from the carrier, allowing the carrier to be transported via the handle 110 in a manner similar to roller luggage. In an illustrative embodiment, the wheels 109 are positioned along a frame 114, which in turn is configured to telescopically received the handle 110.

Figure 5:
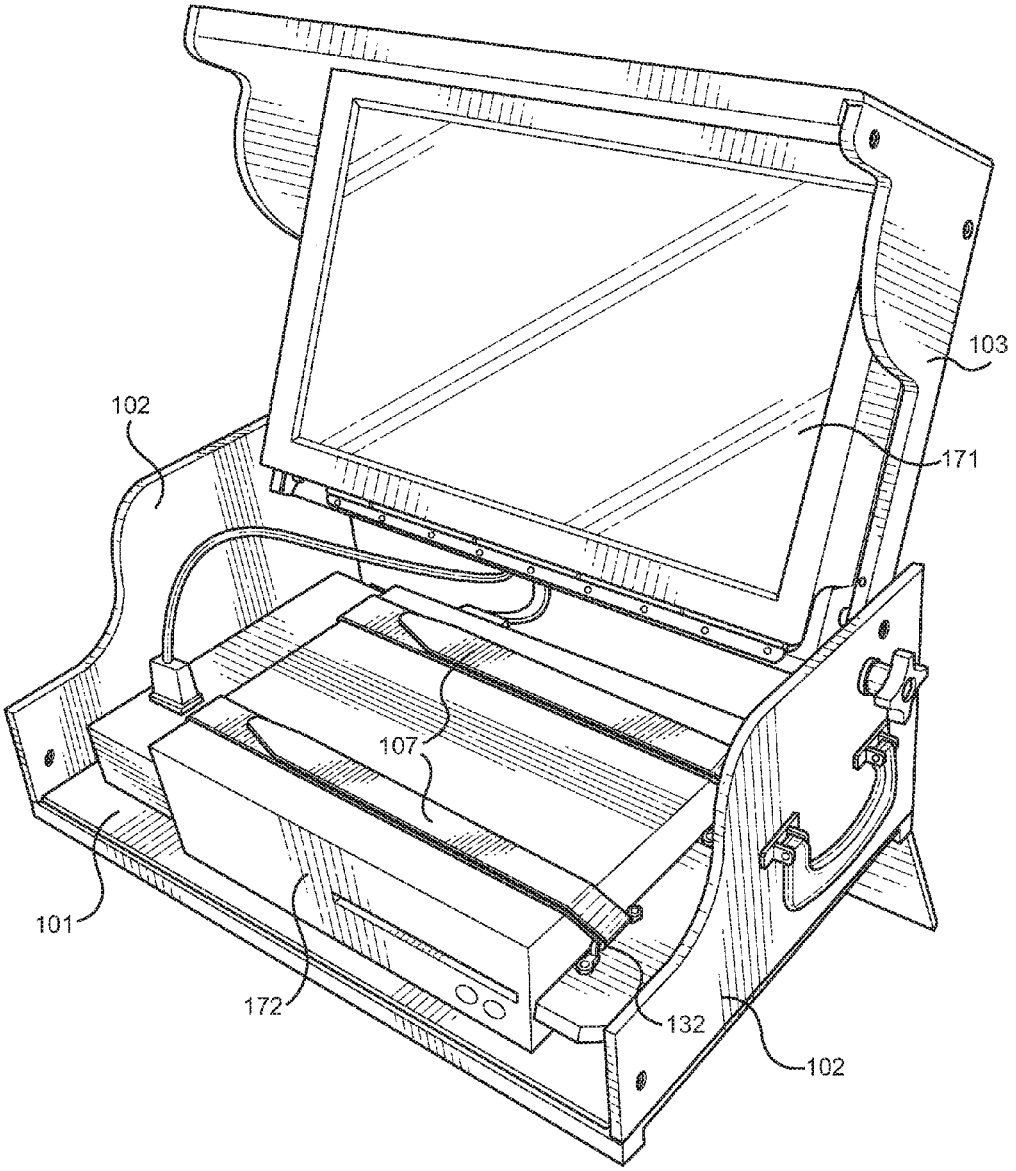
FIG. 5 shows a perspective view of the portable monitor and electronic device carrier carrying a monitor and an electronic device.

Referring now to FIG. 5, there is shown a perspective view of the portable monitor and electronic device carrier carrying a monitor and an electronic device. An article 172, e.g. a video game console, can be secured within the interior of the carrier by tightening the straps 107 about the article 172. When secured within the carrier, the straps 107 prevent the article 172 from moving when the carrier is being transported, regardless of the orientation of the carrier. An electronic display screen 171 is securable to the support member 105 of the carrier by inserting a fastener through each of the slots 112 on the support member 105 and engaging the fasteners with the integral female receivers positioned on the back surface of the electronic display screen 171, similar in manner to the way by which a monitor is securable to a wall mount. As the slots 112 are elongated, the position of the vertical position of the electronic display screen 171 can be adjusted by sliding the electronic display screen 171 to the desired position and then tightening the fasteners until the electronic display screen 171 is held fast against the support member 105.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrier comprising:

a base having an open end opposing a rear wall, a first sidewall opposing a second sidewall, wherein the rear wall and the first and second sidewalls extend upward from the base;

a lid pivotably secured to the first and second sidewalls via a first hinge, along a first axis of the lid;

a third sidewall affixed to the lid and extending orthogonally from an edge of the lid, such that when the carrier is in a closed position the open end of the base receives the third sidewall, forming an enclosed interior volume;

a support member pivotably secured to an interior surface of the lid via a second hinge, the support member including a slot configured to receive a fastener therethrough;

wherein the support member and the lid rotate about the first axis;

a strap extending across an interior surface of the base, the strap configured to secure an article thereto;

a wheel disposed on an exterior surface of the base; and a telescopic handle extendable from the carrier.

2. The carrier of claim 1, further comprising a slot configured to receive a fastener therethrough disposed on the lid, the slot of the lid configured to align with the slot of the support member.

3. The carrier of claim 1, wherein the interior surface of the base is flat.

4. The carrier of claim 1, further comprising a kickstand pivotally extending from the base, wherein the kickstand comprises a planar member.

5. The carrier of claim 1, wherein the support member comprises a protrusion disposed on a periphery and extending between lateral sides thereof, wherein the protrusion is adapted to be received by a recess on an interior side of the lid.

6. The carrier of claim 1, wherein the third sidewall comprises a same length and height as a length and height of the rear wall.

7. The carrier of claim 1, wherein the slot comprises a pair of slots centrally disposed on an upper face of the support member.

8. The carrier of claim 1, wherein a pair of adjacent corners of the support member are beveled.

9. The carrier of claim 1, wherein the first and second sidewalls comprise a cutout and the lid comprises opposing lateral sides, wherein the opposing lateral sides comprise a same shape as each cutout to form an enclosed interior volume when the lid is in the closed position.

* * * * *